US010151082B2

(12) United States Patent
Edmonds

(10) Patent No.: US 10,151,082 B2
(45) Date of Patent: Dec. 11, 2018

(54) EXCAVATION TOOTH ASSEMBLY

(71) Applicant: Bradken Resources Pty Limited, Mayfield West, NSW (AU)

(72) Inventor: Chris Edmonds, Charlestown (AU)

(73) Assignee: Bradken Resources Pty Limited, Mayfield West, NSW (AU)

( * ) Notice: Subject to any disclaimer, the term of this patent is extended or adjusted under 35 U.S.C. 154(b) by 0 days.

(21) Appl. No.: 14/783,606

(22) PCT Filed: Apr. 11, 2014

(86) PCT No.: PCT/AU2014/000408
§ 371 (c)(1),
(2) Date: Oct. 9, 2015

(87) PCT Pub. No.: WO2014/165928
PCT Pub. Date: Oct. 16, 2014

(65) Prior Publication Data

US 2016/0083935 A1 Mar. 24, 2016

(30) Foreign Application Priority Data

Apr. 12, 2013 (AU) ..... 2013204854

(51) Int. Cl.
*E02F 9/28* (2006.01)

(52) U.S. Cl.
CPC ..... *E02F 9/2833* (2013.01); *E02F 9/2825* (2013.01); *E02F 9/2841* (2013.01)

(58) Field of Classification Search
CPC ..... E02F 9/2833; E02F 9/2841; E02F 9/2825; E02F 9/2816
See application file for complete search history.

(56) References Cited

U.S. PATENT DOCUMENTS 4,414,764 A 11/1983 Johansson et al.
4,761,900 A * 8/1988 Emrich ..... E02F 9/2841 37/457

(Continued)

FOREIGN PATENT DOCUMENTS

GB 1180310 2/1970
WO WO-03/048462 6/2003

(Continued)

OTHER PUBLICATIONS

International Search Report dated Apr. 8, 2015, directed towards International Application No. PCT/AU2014/000408, 8 pages.

(Continued)

*Primary Examiner* — Matthew D. Troutman
(74) *Attorney, Agent, or Firm* — Morrison & Foerster LLP

(57) ABSTRACT

An excavation tooth lock assembly to lock a first tooth member to a second tooth member, the first tooth member having a body that incorporates a socket which is configured to receive a nose portion of the second tooth member, a locking space provided when the second tooth member is received in the first tooth member, wherein the lock assembly comprises: a lock comprising a body which is configured to be inserted into the locking space including by rotating the body into an operative position to lock the first tooth member to the second tooth member and interengaging elements disposed on the lock and one or both of the first and second tooth members, the elements configured to releaseably retain the lock within the locking space in its operative position.

24 Claims, 19 Drawing Sheets

(56) References Cited

U.S. PATENT DOCUMENTS

| | | | | |
|---|---|---|---|---|
| RE33,042 | E * | 9/1989 | Emrich | E02F 9/2841 37/459 |
| 4,965,945 | A * | 10/1990 | Emrich | E02F 9/2841 37/456 |
| 5,913,605 | A * | 6/1999 | Jusselin | E02F 9/28 172/772 |
| 5,983,534 | A * | 11/1999 | Robinson | E02F 9/2841 37/452 |
| 8,127,476 | B2 * | 3/2012 | Bierwith | E02F 9/2833 172/772 |
| 8,387,290 | B2 * | 3/2013 | Campomanes | E02F 9/2825 37/456 |
| 8,555,532 | B2 * | 10/2013 | Lopez Almendros | E02F 9/2841 172/772 |
| 9,080,313 | B2 * | 7/2015 | Goodwin | E02F 9/2825 |
| 9,469,974 | B2 * | 10/2016 | Guimaraes | E02F 9/2825 |
| 9,476,184 | B2 * | 10/2016 | Wallis | E02F 9/2825 |
| 2003/0070330 | A1 * | 4/2003 | Olds | E02F 9/2825 37/456 |
| 2007/0193075 | A1 | 8/2007 | Carpenter | |
| 2007/0227051 | A1 | 10/2007 | Carpenter et al. | |
| 2008/0028644 | A1 | 2/2008 | Lopez Almendros et al. | |
| 2010/0170119 | A1 | 7/2010 | Lopez Almendros et al. | |
| 2011/0023336 | A1 | 2/2011 | Briscoe | |
| 2012/0055052 | A1 | 3/2012 | Campomanes et al. | |
| 2012/0260539 | A1 * | 10/2012 | Guimaraes | E02F 9/2825 37/452 |
| 2012/0304506 | A1 | 12/2012 | Guimaraes et al. | |
| 2013/0185965 | A1 * | 7/2013 | Bartolome Rodriguez | E02F 9/2883 37/453 |
| 2015/0275485 | A1 * | 10/2015 | Almendros | E02F 9/2825 37/457 |

FOREIGN PATENT DOCUMENTS

| | | |
|---|---|---|
| WO | WO-2004/029371 | 4/2004 |
| WO | WO-2013/033751 | 3/2013 |

OTHER PUBLICATIONS

Patent Examination Report No. 2 dated Feb. 25, 2016, directed to AU Application No. 2013204873; 6 pages.

Patent Examination Report No. 2 dated Feb. 25, 2016, directed to AU Application No. 2013204892; 6 pages.

Patent Examination Report No. 3 dated Feb. 25, 2016, directed to AU Application No. 2013204854; 7 pages.

* cited by examiner

15

EXCAVATION TOOTH ASSEMBLY

CROSS-REFERENCE TO RELATED APPLICATIONS

This application is a national stage application under 35 U.S.C. 371 of International Patent Application No. PCT/AU2014/000408, filed on Apr. 11, 2014, which claims the priority of Australian Application No. AU 2013204854, filed Apr. 12, 2013, the contents of which are incorporated herein by reference in their entirety.

FIELD OF THE INVENTION

The disclosure relates to excavation tooth assemblies, lock assemblies for use in such tooth assemblies and to components of such excavation tooth and lock assemblies. The disclosure has application in land based digging equipment and is herein described in that context. However, it is to be appreciated that the disclosure has broader application for example in waterborne excavation equipment such as dredgers, and is therefore not limited to that application.

BACKGROUND OF THE INVENTION

Excavation teeth are provided on the digging edge of various pieces of digging equipment such as the buckets of front end loaders. Each excavation tooth is formed of a number of parts, commonly a point, an adapter and a lock. The adapter is typically fitted to the excavation equipment and the point fits over the adapter and is retained in place by the lock. In some instances one or more intermediate parts may be also included between the point and the adapter. For ease of description it is to be understood that, unless the context requires otherwise, the term "adapter" used in this specification includes both the adapter arranged to be fitted to the excavation equipment or, if one or more intermediate parts are provided, to that intermediate part(s) or to the combination of the adapter and the intermediate part(s).

The reason that the excavation tooth is formed of a number of parts is to avoid having to discard the entire tooth when only parts of the tooth, in particular the ground engaging part of the tooth (i.e. the point) is worn or broken.

Various types of locks, points and adapters are known. However, it is always desirable to design new excavation tooth assemblies and parts thereof.

SUMMARY OF THE INVENTION

The present disclosure relates to improvements in relation to excavation tooth assemblies, lock assemblies for use in such tooth assemblies and to components of such excavation tooth and lock assemblies adapted to engage with excavation equipment.

In one aspect of the disclosure, there is provided an excavation tooth lock assembly to lock a first tooth member to a second tooth member, the first tooth member having a body that incorporates a socket which is configured to receive a nose portion of the second tooth member, a locking space provided when the second tooth member is received in the first tooth member, wherein the lock assembly comprises:

a lock comprising a body which is configured to be inserted into the locking space including by rotating the body into an operative position to lock the first tooth member to the second tooth member and interengaging elements disposed on the lock and one or both of the first and second tooth members, the elements configured to releaseably retain the lock within the locking space in its operative position.

In another aspect of the disclosure there is provided a lock for locking a first tooth member to a second tooth, the first tooth member having a body that incorporates a socket which is configured to receive a nose portion of the second tooth member, whereby a locking space is provided when the second tooth member is received in the first tooth member, wherein the lock comprises:

a body which is configured to be inserted into the locking space including by rotating the body into an operative position to lock the first tooth member to the second tooth member; and an interengaging element disposed on the lock body configured to releaseably retain the lock within the locking space in its operative position by engaging with an interengaging element provided on one or both of the first and second tooth members.

In another aspect of the disclosure there is provided an excavation tooth member comprising a body incorporating a first end, an opposite second end that incorporates a socket configured to receive a nose portion of a further tooth member, and a wall that in use forms part of a locking space arranged to receive a lock, the wall including a depressible locking detent that forms part of a lock assembly to releaseably retain the lock in the locking space.

In another aspect of the disclosure there is provided an excavation tooth assembly for attachment to a digging edge, the assembly comprising:

a first tooth member;

a second tooth member, the first tooth member having a body that incorporates a socket which is configured to receive a nose portion of the second tooth member in an assembled condition, wherein a locking space is formed when the tooth members are in their assembled condition; and a lock that is inserted into the locking space to lock the tooth members in their assembled condition, wherein the lock comprises a lock as described in above aspects.

In another aspect of the disclosure there is provided an excavation tooth assembly for attachment to a digging edge, the assembly comprising:

a first tooth member comprising an excavation tooth member as described in above aspects;

a second tooth member having a nose portion that is configured to be received in the socket of the first tooth member in an assembled condition, wherein the locking space is formed when the tooth members are in their assembled condition; and a lock that is inserted into the locking space to lock the tooth members in their assembled condition.

In another aspect of the disclosure there is provided a method of assembling a first tooth member and a second tooth member in an excavation tooth assembly, the method comprising:

coupling the first tooth member to the second member by receiving a nose portion of the second tooth member in a socket of the first tooth member; and inserting a lock into a locking space formed by the first and second tooth members to releaseably retain the lock within the locking space in an operative position where it locks the first tooth member to the second tooth member, inserting the locking comprising in a first step, translating the lock partially into the locking space and then in a second step rotating the lock further into the locking space to its operative position.

In another aspect of the disclosure, there is provided an excavation tooth lock assembly to lock a first tooth member to a second tooth member, the first tooth member having a body that incorporates a socket which is configured to receive a nose portion of the second tooth member, a locking space provided when the second tooth member is received in the first tooth member, wherein the lock assembly comprises:

a lock comprising a body which is configured to be inserted into the locking space including by rotating the body into an operative position to lock the first tooth member to the second tooth member; and a take-up formation provided on at least one of the lock, the first tooth member or the second tooth member, the take-up formation biasing the first tooth member onto the second tooth member.

In another aspect of the disclosure, there is provided a lock for locking a first tooth member to a second tooth member, the first tooth member having a body that incorporates a socket which is configured to receive a nose portion of the second tooth member, whereby a locking space is provided when the second tooth member is received in the first tooth member, wherein the lock comprises:

a body which is configured to be inserted into the locking space including by rotating the body into an operative position to lock the first tooth member to the second tooth member; and a take-up formation that is arranged to bias the lock into tighter engagement with at least one surface of the locking space when the lock is inserted into the locking space.

In another aspect of the disclosure, there is provided a method of locking a first tooth member to a second tooth member, the first tooth member having a body that incorporates a socket which is configured to receive a nose portion of the second tooth member, whereby a locking space is provided when the second tooth member is received in the first tooth member, the method comprising:

inserting a lock into the locking space;

rotating the lock in the locking space either during or after insertion; whereby the lock is caused to lock the first tooth member to the second tooth member and bias the first tooth member onto the second tooth member.

DETAILED DESCRIPTION OF THE INVENTION

Figure 1:
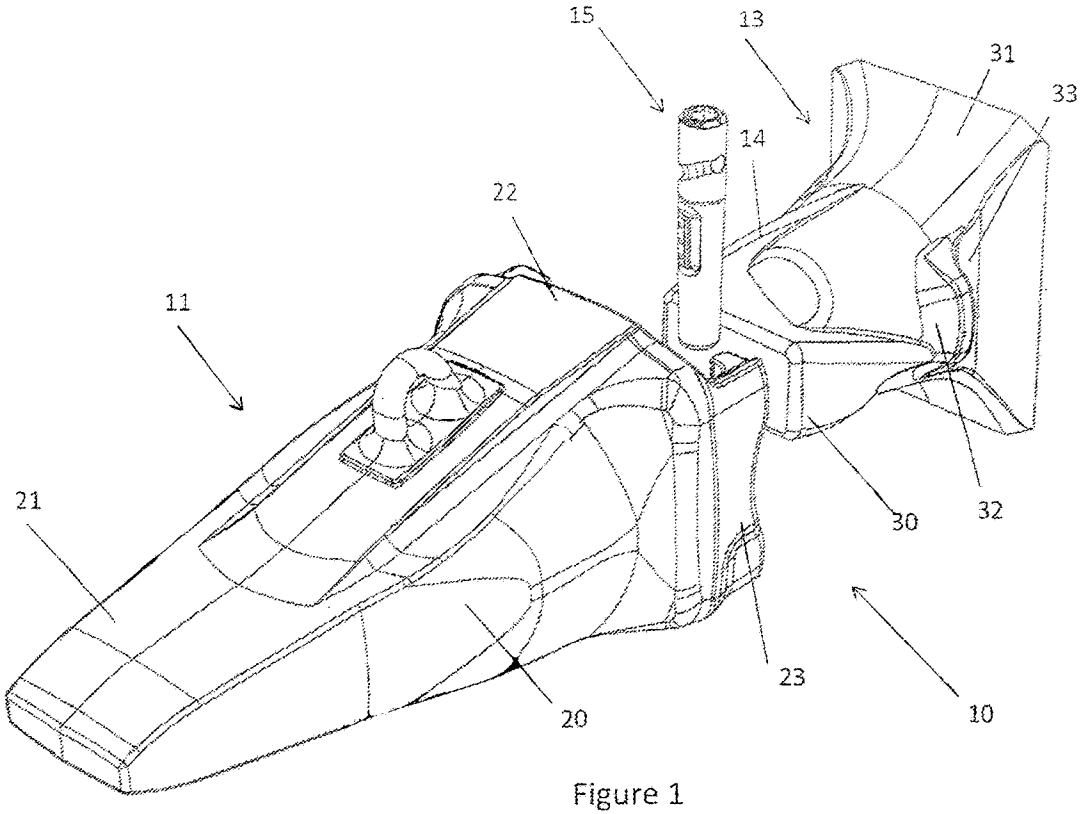
FIG. 1 is an exploded perspective view of an excavation tooth assembly according to an embodiment of the present disclosure.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure relates generally to excavation tooth assemblies for digging equipment. In the illustrated embodiment, an excavation tooth assembly is shown comprising a point tooth member that is mounted to a nose portion that is fixed to a bucket lip or other digging edge. The nose portion may be part of an adapter or may be integrally formed to the digging edge. However, it is to be understood that embodiments of the present disclosure could be applied to excavation tooth assemblies in which the point tooth member is mounted to an intermediate member (which may also be referred to as an adapter) that in turn is mounted to a nose that forms part of the digging edge or to the nose of a further tooth member that is mounted to the digging edge. In the excavation tooth assemblies of the present disclosure, a lock is used to lock the point tooth member to the nose of the adapter or the nose integrally formed with the digging edge. Similarly, in excavation tooth assemblies comprising an intermediate member, locks are used to lock the point to the intermediate member and the intermediate member to the nose formed with the digging edge or of the tooth member attached to the digging edge.

Disclosed in some embodiments is an excavation tooth lock assembly to lock a first tooth member to a second tooth member, the first tooth member having a body that incorporates a socket which is configured to receive a nose portion of the second tooth member, a locking space provided when the second tooth member is received in the first tooth member, wherein the lock assembly comprises:

a lock comprising a body which is configured to be inserted into the locking space including by rotating the body into an operative position to lock the first tooth member to the second tooth member and interengaging elements disposed on the lock and one or both of the first and second tooth members, the elements configured to releaseably retain the lock within the locking space in its operative position.

Disclosed in some embodiments is a lock for locking a first tooth member to a second tooth member, the first tooth member having a body that incorporates a socket which is configured to receive a nose portion of the second tooth member, whereby a locking space is provided when the second tooth member is received in the first tooth member, wherein the lock comprises:

a body which is configured to be inserted into the locking space including by rotating the body into an operative position to lock the first tooth member to the second tooth member; and an interengaging element disposed on the lock body configured to releaseably retain the lock within the locking space in its operative position by engaging with an interengaging element provided on one or both of the first and second tooth members.

Advantageously, the lock is configured to be inserted into the locking space by rotation and as such can be brought into its operative position without the use of a hammer. This makes it easier and safer to install the lock. Furthermore, by providing the lock with a groove that travels over the locking detent as it is being inserted, the lock is accurately guided into its operative position and reduces the risk of the lock jamming.

In some embodiments, the lock body extends along a longitudinal axis between first and second ends and wherein the lock assembly is configured such that rotation of the lock body to the operative position is made against a biasing force which is applied to the lock transverse to the longitudinal axis of the lock body.

In some embodiments, one of the interengaging elements is depressible and the depressible element provides the transverse bias.

In some embodiments, the assembly is configured so that the biasing force increases as the lock is rotated to the operative position.

In some embodiments, the locking space is formed, at least in part, by surfaces of the first and second tooth members which are disposed to face laterally relative to the forward and rear ends of the tooth assembly and which are arranged in opposing relation to one another and at least one of the interengaging elements is provided on one of these laterally facing surfaces.

In some embodiments, the first tooth member comprises an ear that projects away from the socket and which incorporates one of the laterally facing surfaces.

In some embodiments, another of the laterally facing surfaces comprises a shoulder portion that projects away from the socket of the first tooth member, the shoulder portion bending towards the ear.

In some embodiments, at least a portion of the laterally facing surfaces are curved to define a curved cavity in the locking space.

In some embodiments, the interengaging element disposed on the first and/or second tooth members is located in the curved cavity.

In some embodiments, the interengaging element disposed on the lock comprises a groove formed in the lock body.

In some embodiments, at least one of the interengaging elements provided on the first and/or second tooth members comprises a locking detent and the groove in the lock body is configured to receive and travel over the locking detent as the lock is inserted into its operative position.

In some embodiments, the locking detent is disposed on one of the walls defining the locking space and is depressible into the wall on which it is provided.

In some embodiments, the locking detent comprises a rigid portion and a resilient portion.

In some embodiments, the resilient portion is positioned in a recess into the wall on which the locking detent is provided.

In some embodiments, the rigid portion has an extended configuration in which it projects from the recess, the resilient portion biasing the rigid portion towards its extended configuration.

In some embodiments, the rigid portion has first and second ends, the first end received in the groove of the lock body as the lock is inserted into its operative position and the second end connected to the resilient portion.

In some embodiments, the rigid portion comprises a body having outward facing surface shaped to conform to the outer surface of the lock body and a projection from the outward facing surface, configured to be received in the groove of the lock body.

In some embodiments, the outward facing surface of the rigid portion is concavely curved.

In some embodiments, the resilient portion comprises an expandable region which is configured to expand when the locking detent is depressed.

In some embodiments, the expandable region comprises a peripheral groove in the resilient portion.

In some embodiments, the locking detent comprises a casing extending over at least part of the side surfaces of the rigid portion, preferably the casing is part of the resilient portion.

In some embodiments, the locking detent comprises a locating formation configured to key into a corresponding formation provided on one of the walls defining the locking space to position the locking detent.

In some embodiments, the lock body extends along a longitudinal axis between a first end and a second end, the lock body configured to be rotated about its longitudinal axis when inserted into its operative position in the locking space.

In some embodiments, the lock body is substantially cylindrical in shape and the groove extends over the outer surface of the lock body.

In some embodiments, a portion of the lock body is tapered, preferably to the first end of the lock body.

In some embodiments, the groove extends from the first end towards the second end of the lock body and finishes in a discontinuity for receiving the locking detent when the lock is in its operative position.

In some embodiments, the discontinuity is an indentation in the lock body.

In some embodiments, the indentation is hemi-spherical in shape.

In some embodiments, the groove has an axial portion that extends over the surface of the lock body substantially parallel to the longitudinal axis of the lock body and a helical portion that extends from one end of the axial portion over the surface of the lock body, substantially helically relative to the longitudinal axis of the lock body.

The axial portion provides a lead-in portion for the groove to capture the locking detent as the lock is partially inserted into the locking space by translation. The helical portion of the groove enables the groove to be further drawn into the locking space to its operative position, by rotation of the lock over the locking detent.

In some embodiments, the axial portion of the groove deepens as it extends towards the helical portion of the groove.

In some embodiments, the helical portion of the groove becomes shallower as it extends away from the axial portion.

In some embodiments, the helical portion extends towards the second end of the lock body as it extends away from the axial portion.

In some embodiments, the groove becomes shallower as it extends towards the discontinuity. Where the discontinuity is an indentation, the indentation is deeper than the portion of the groove adjacent to the indentation.

With this arrangement, as the lock is rotated towards its operative position, the engagement of the groove with the locking detent tightens as the lock is rotated until the locking detent is released into the indentation at the end of the groove to captively retain the locking detent in the indentation. At this point, the lock is in its operative position. To remove the lock from the locking space, sufficient rotational force is required to release the locking detent from the indentation.

In some embodiments, the discontinuity is located at the end of the helical portion of the groove distal from the axial portion.

In some embodiments, the lock comprises an actuator portion formed in the lock body for engagement by an operator to cause rotation of the lock body.

In some embodiments, the actuator portion comprises a recess or protrusion, preferably an hexagonal recess.

In some embodiments, the actuator portion is located in an end face of the lock body at its second end.

In some embodiments, the lock comprises a take-up formation for biasing the first tooth member onto the second tooth member.

In some embodiments, the take-up formation is configured to expand the lock under its bias.

In some embodiments, the bias of the take-up formation causes the formation to extend from the lock.

In some embodiments, the take-up formation comprises a lateral projection extending from a side of the lock body for engaging one of the surfaces that defines the locking space.

In some embodiments, the lateral projection is depressible towards the lock body.

In some embodiments, the lateral portion comprises a rigid portion and a resilient portion.

In some embodiments, the resilient portion is located in a recess formed in the lock body.

In some embodiments, the rigid portion has an extended configuration in which it projects beyond the side of the lock body and the resilient portion biases the rigid portion towards its extended configuration.

Advantageously, the bias of the lateral projection to its extended configuration provides lake-up' for wear that occurs on the components of the excavation tooth assembly as it is used. This enables the engagement of the lock with the walls of the locking space to remain tight over an extended period of service.

In some embodiments, the rigid portion has a curved leading edge that transitions into a substantially planar outer surface.

In some embodiments, the lateral projection extends axially substantially parallel to the longitudinal axis of the lock body.

Disclosed in some embodiments is an excavation tooth member comprising a body incorporating a first end, an opposite second end that incorporates a socket configured to receive a nose portion of a further tooth member, and a wall that in use forms part of a locking space arranged to receive a lock, the wall including a depressible locking detent that forms part of a lock assembly to releaseably retain the lock in the locking space.

The tooth member may be the first tooth member as described in any one of the above embodiments.

In some embodiments, the tooth member comprises an ear that projects away from the socket and which incorporates the wall on which the depressible locking detent is located.

In some embodiments, the tooth member has one or more inward projections located on the ear and spaced from the second end of the tooth member body, each inward projection together with the ear and the second end defining a curved cavity that forms part of the locking space.

In some embodiments, the tooth member has upper and lower inward projections on the ear which define respectively upper and lower curved cavities with the ear and the second end of the tooth member body.

In some embodiments, the tooth member comprises a shoulder portion that projects away from the second end, the shoulder portion bending towards the ear and defining part of one of the curved cavities Disclosed in some embodiments is an excavation tooth assembly for attachment to a digging edge, the assembly comprising:

a first tooth member;

a second tooth member, the first tooth member having a body that incorporates a socket which is configured to receive a nose portion of the second tooth member in an assembled condition, wherein a locking space is formed when the tooth members are in their assembled condition; and a lock that is inserted into the locking space to lock the tooth members in their assembled condition, wherein the lock comprises a lock as described in any one of the above embodiments.

The first tooth member may be an excavation tooth member as described in any one of the above embodiments.

Disclosed in some embodiments is an excavation tooth assembly for attachment to a digging edge, the assembly comprising:

a first tooth member comprising an excavation tooth member as described in any one of the above embodiments;

a second tooth member having a nose portion that is configured to be received in the socket of the first tooth member in an assembled condition, wherein the locking space is formed when the tooth members are in their assembled condition; and a lock that is inserted into the locking space to lock the tooth members in their assembled condition.

Disclosed in some embodiments is a method of assembling a first tooth member and a second tooth member in an excavation tooth assembly, the method comprising:

coupling the first tooth member to the second member by receiving a nose portion of the second tooth member in a socket of the first tooth member; and inserting a lock into a locking space formed by the first and second tooth members to releaseably retain the lock within the locking space in an operative position where it locks the first tooth member to the second tooth member, inserting the locking comprising in a first step, translating the lock partially into the locking space and then in a second step rotating the lock further into the locking space to its operative position.

In some embodiments, the lock has a lock body with a groove formed thereon and a locking detent is provided on a wall defining the locking space, wherein inserting the lock into the locking space comprises receiving the locking detent in the groove on the lock body.

In some embodiments, the lock is moved so that the groove travels over the locking detent in the first and second steps of inserting the lock.

Disclosed in some embodiments is an excavation tooth lock assembly to lock a first tooth member to a second tooth member, the first tooth member having a body that incorporates a socket which is configured to receive a nose portion of the second tooth member, a locking space provided when the second tooth member is received in the first tooth member, wherein the lock assembly comprises:

a lock comprising a body which is configured to be inserted into the locking space including by rotating the body into an operative position to lock the first tooth member to the second tooth member; and a take-up formation provided on at least one of the lock, the first tooth member or the second tooth member, the take-up formation biasing the first tooth member onto the second tooth member.

In some embodiments, the take-formation is disposed on the lock.

In some embodiments, the take-up formation is caused to move into engagement with one of the first tooth member or second tooth member on rotation of the body so as to bias the first tooth member onto the second tooth member.

In some embodiments, the take-up formation comprises a resilient member.

In some embodiments, the take-up formation causes tightening of the engagement of the lock with at least one surface of the locking space.

In some embodiments, the lock assembly also comprises interengaging elements disposed on the lock and one or both of the first and second tooth members, the elements configured to releaseably retain the lock within the locking space in its operative position.

Disclosed in some embodiments is a lock for locking a first tooth member to a second tooth member, the first tooth member having a body that incorporates a socket which is configured to receive a nose portion of the second tooth member, whereby a locking space is provided when the second tooth member is received in the first tooth member, wherein the lock comprises:

A body which is configured to be inserted into the locking space including by rotating the body into an operative position to lock the first tooth member to the second tooth member; and a take-up formation that is arranged to bias the lock into tighter engagement with at least one surface of the locking space when the lock is inserted into the locking space.

In some embodiments, the lock also comprises an interengaging element disposed on the lock body configured to releaseably retain the lock within the locking space in its operative position by engaging with an interengaging element provided on one or both of the first and second tooth members.

Disclosed in some embodiments is a method of locking a first tooth member to a second tooth member, the first tooth member having a body that incorporates a socket which is configured to receive a nose portion of the second tooth member, whereby a locking space is provided when the second tooth member is received in the first tooth member, the method comprising:

inserting a lock into the locking space;

rotating the lock in the locking space either during or after insertion; whereby the lock is caused to lock the first tooth member to the second tooth member and bias the first tooth member onto the second tooth member.

In some embodiments, the lock is rotated during insertion into the locking space.

In some embodiments, rotation of the lock in the locking space causes the lock to engage with interengaging element provided on one or both of the first and second tooth members to releaseably retain the lock within the locking space.

In some embodiments, rotation of the lock in the locking space causes a take up formation to become operative to bias the first tooth member onto the second tooth member.

Figure 23A:
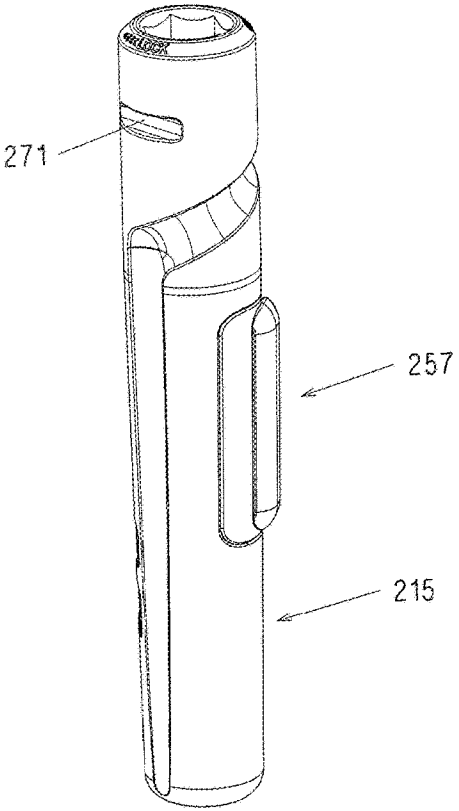
FIG. 23 is a number of elevated side views of a lock of an excavation tooth assembly according to another embodiment of the present disclosure.
Figure 23B:
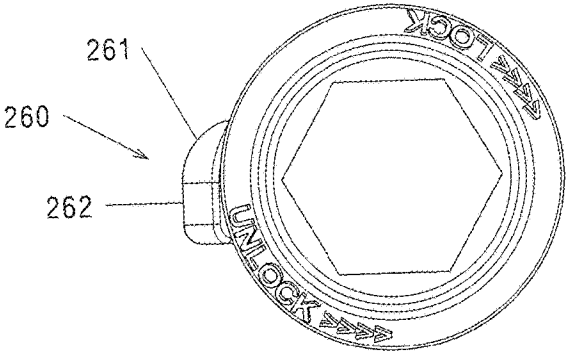

Referring now to FIGS. 1-20, there is shown an excavation tooth assembly 10 comprising a first tooth member 11 having a socket 12 and a second tooth member 13 having a nose portion 14 and a lock 15. The second tooth member 13 is attached to the digging edge of a piece of digging equipment and the socket 12 of the first tooth member 11 is configured to receive the nose portion 14 of the second tooth member when the tooth members are brought into an assembled condition as shown for example in FIG. 14. The lock 15 is inserted into a locking space 16 that is formed between the tooth members 11, 13 when they are in their assembled condition. With the lock 15 placed in an operative position within the locking space 16, the first and second tooth members 11, 13 are locked in their assembled condition. It is noted that FIG. 23 shows a lock 215 according to another embodiment which could alternatively be incorporated into the excavation tooth assembly 10 instead of the lock 15.

The first tooth member 11 has a body 20 extending along a longitudinal axis between first and second ends 21, 22. The socket 12 extends into the body 20 from the second end 22 and a digging edge is provided at the first end 21. The first tooth member 11 also has ears 23 extending from the second end 22 on either side of the tooth member body 20. The ears 23 are arranged laterally with respect to the longitudinal axis of the first tooth member. Upper and lower projections 24 are provided on each of the ears 23 at the distal end of each ear from the tooth member body 20. Each of the projections 24 extend inwardly, approximately perpendicularly from the ear. The surface of the tooth member 11 where the projections 24 join to their respective ears 23 is curved. The projections 24 together with their respective ears 23 and a portion of the second end face 25 of the tooth member body 20 form upper and lower cavities 26, each having a curved surface. End surfaces of upper and lower ridges 27 formed on the second end face 25 of the tooth member body 20 also, in part, define the respective upper and lower cavities 26.

Figure 3:
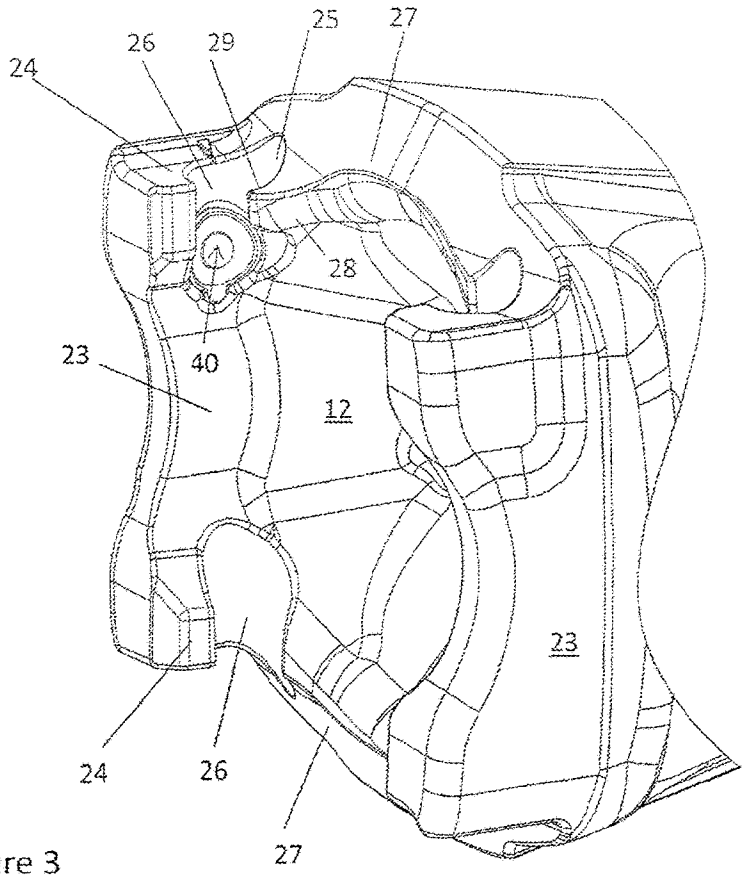
FIG. 3 is partial rear perspective view of a first tooth member of the excavation tooth assembly of FIG. 1.
Figure 6:
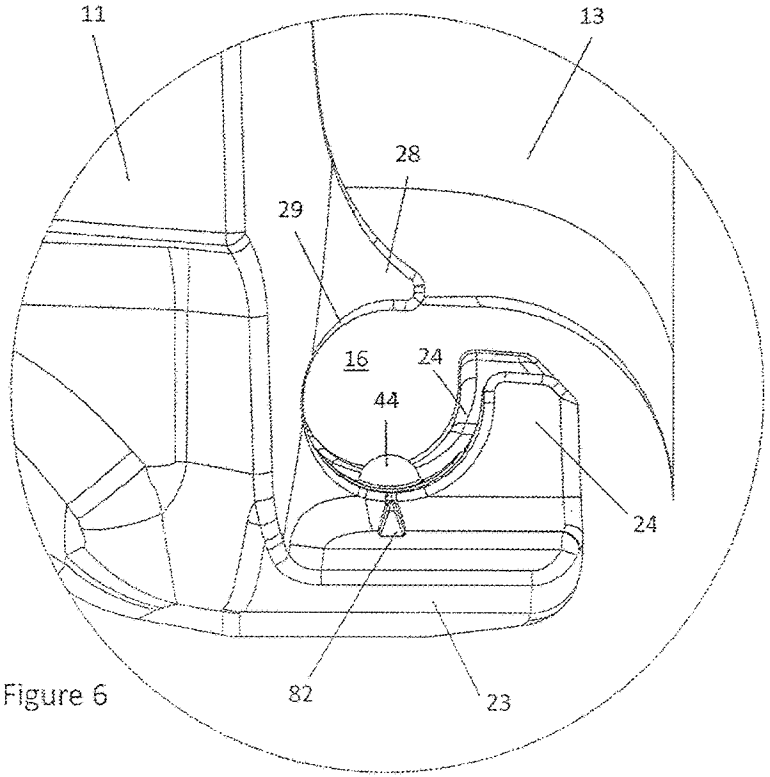
FIG. 6 a top view of a locking space that is formed when first and second tooth members of the excavation tooth assembly of FIG. 1 are assembled.
Figure 7:
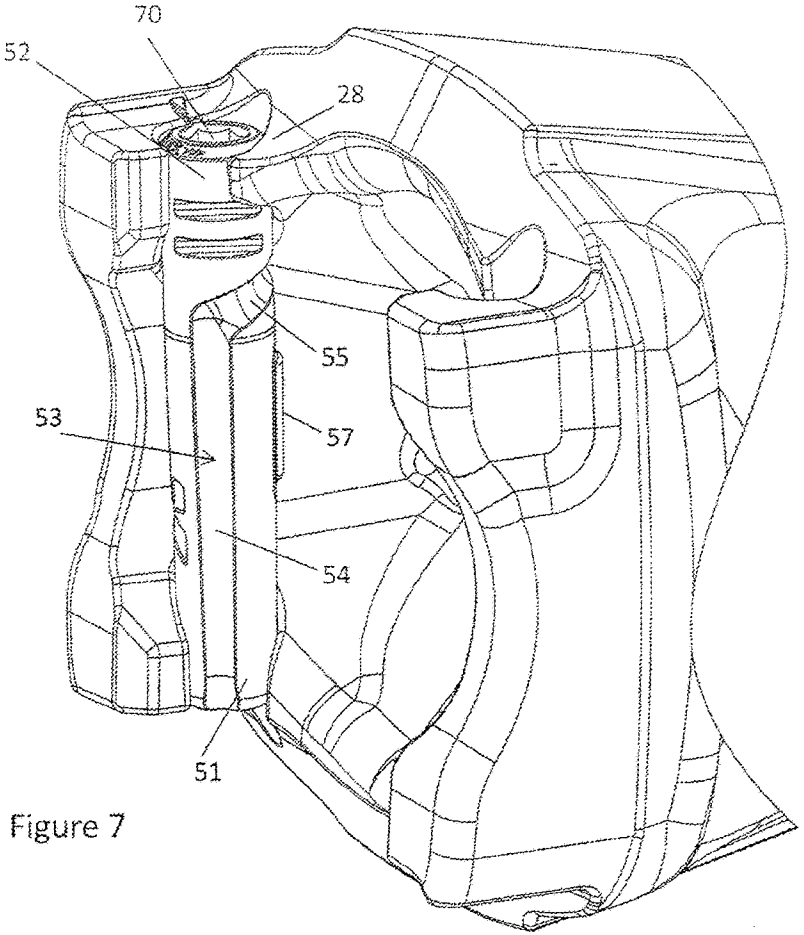
FIG. 7 is a rear perspective view showing how the lock of FIG. 2 is positioned with respect to the tooth member of FIG. 3 when the excavation tooth assembly of FIG. 1 is assembled.

As shown in FIGS. 3, 6 and 7, the ridges 27 each have at at least one end, a pronounced shoulder portion 28 that extend and curve towards the ear 23 facing that end of the ridge to define part of one of cavities 26. Each shoulder portion 28 defines a concavely curved end surface 29 of its respective ridge which together with the facing ear 23 and one of the ear's respective projections 24, provides a continuous surface that will wrap almost completely around the lock 15 when it is inserted into the locking space 16. This helps keep the lock 15 in tight engagement with the tooth members 11, 13 when in its operative position. It is noted that in other embodiments, both ends of each ridge may have such shoulder portions.

The nose portion 14 of the second tooth member 13 extends along a longitudinal axis between first and second ends 30, 31, ending in an end face at its first end. A wall portion 32 extends transversely to the longitudinal axis from respective side walls 33 of the nose portion 14. Each wall portion 32 is located towards the second end 31 of the nose portion. The wall portions 32 are configured so that when the first and second tooth members 11, 13 are in their assembled condition with the nose portion 14 received in the socket 12 of the first tooth member 11, the ears 23 of the first tooth member extend past respective wall portions 32. In this configuration the wall portions 32 are located forward of the inward projections 24 on the respective ears 23 (when the tooth members are in their assembled condition).

Each wall portion 32 together with their respective side wall 33 of the second tooth member 13 and the respective ear 23, its respective inward projections 24, end surfaces 29 of the upper and lower ridges 27 and a portion of the second end face 25 of the first tooth member 11 define a locking space 16 for receiving the lock 15. Each locking space 16 thus incorporates the upper and lower cavities 26 formed in respect of the respective ears 23 of the first tooth member 11. Each locking space 16 is positioned laterally with respect to the tooth members 11, 13 (rather than extending through the tooth members) and extends transversely with respect to their respective longitudinal axes.

However, only a single lock need be inserted into one of the locking spaces to secure the first and second tooth members 11, 13 in their assembled condition. The configuration of the tooth members in the embodiment shown, enables the first tooth member 11 to be mounted to the second tooth member 13 upside down and also enables a lock to be inserted either side of the tooth members. In other embodiments, the first tooth member may be provided with only one ear and/or the second tooth member may be provided with only one side wall portion such that only one locking space is defined when they are brought into an assembled condition. In these embodiments, the tooth members would have to be assembled in a specific orientation so that the locking space was formed.

Figure 4:
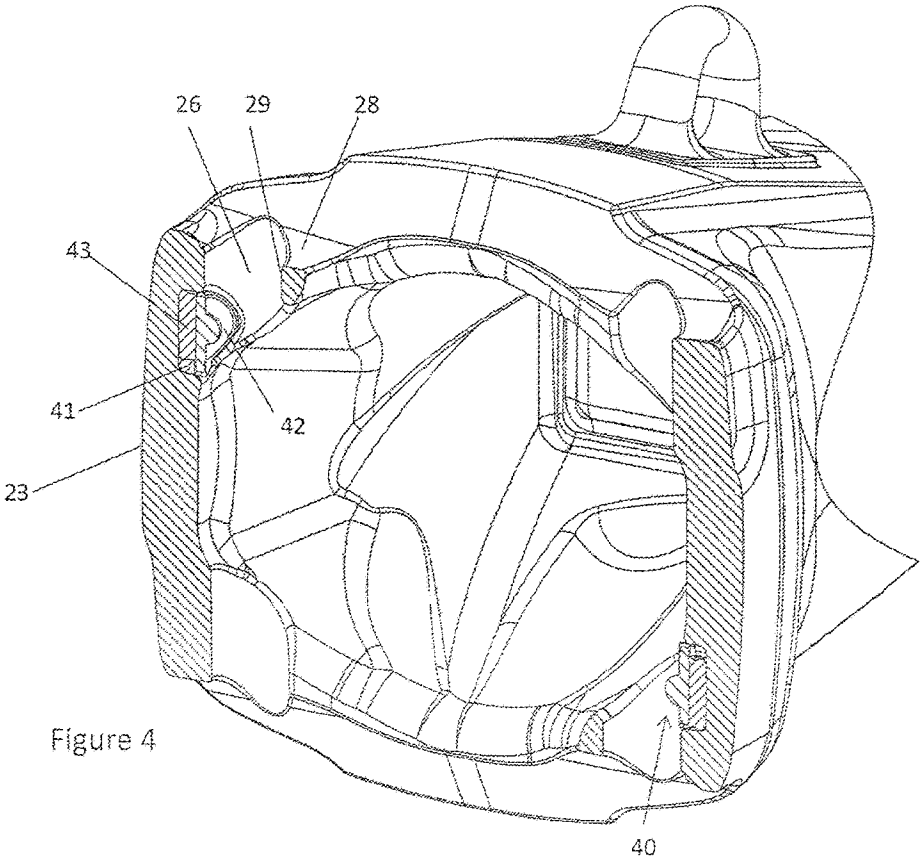
FIG. 4 is a sectional view through an ear of the tooth member of FIG. 3.
Figure 5:
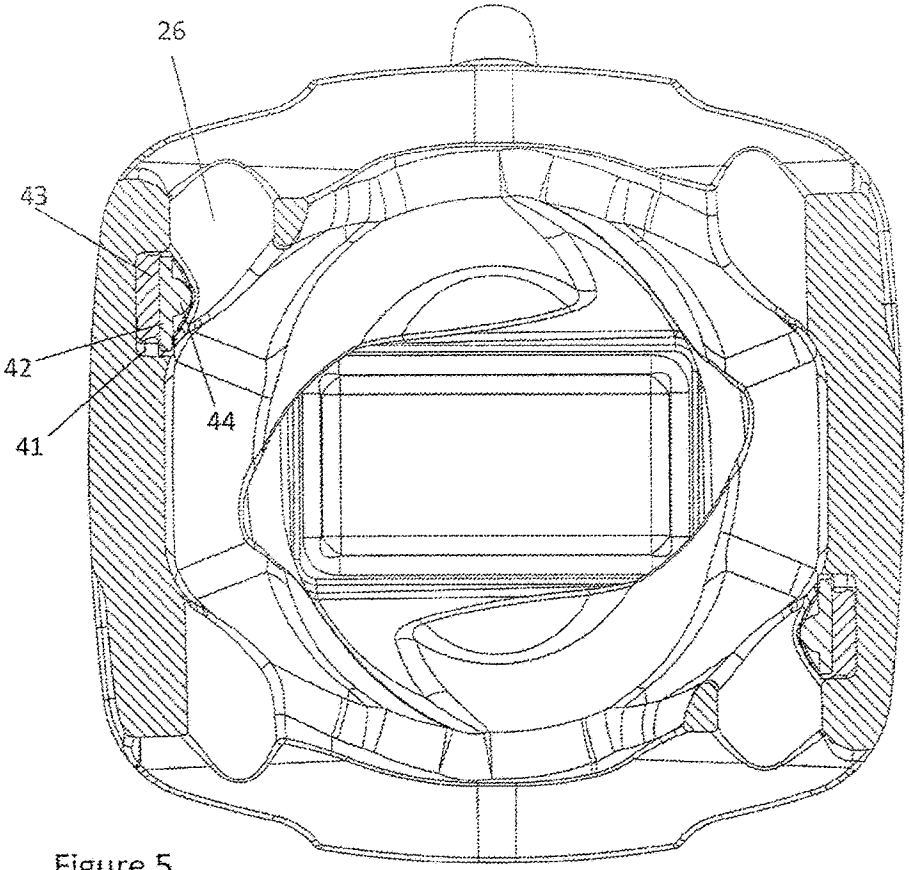
FIG. 5 is a rear view of the tooth member of FIG. 3.

Referring specifically to FIGS. 3-5, the first tooth member 11 is provided with an interengaging element in the form of a locking detent 40 associated with each of the locking spaces 16. The locking detent 40 extends from a surface of the ear 23. The locking detent 40 is for engaging the lock 15 to retain it in the locking space 16 when the lock is so inserted.

Each locking detent 40 is located on a surface of the upper cavity 26 formed in respective ears 23. Each locking detent 40 is retained within a recess 41 formed in that ear 23 and in an extended configuration projects from the recess 41 into the upper cavity 26 (and hence into the locking space 16 when the tooth members are assembled). It is noted that the upper cavity 26 of respective ears are located diagonally opposite each other, as shown in FIG. 5. This is to enable the first tooth member 11 to be used upside down as discussed above.

The following description of the locking detent 40 applies to each locking detent.

The locking detent 40 has a rigid portion 42 and a resilient portion 43, to which the rigid portion is fixed. The resilient portion 43 is housed in the recess 41 and enables the locking detent 40 to be depressed in a direction towards the ear 23. The resilient portion 43 also biases the rigid portion 42 away from the ear so that the locking detent is biased towards its extended configuration as shown in FIGS. 3 and 4. The resilient portion may be formed of an elastomeric material such as rubber or a spring. The rigid portion 42 is fixed at one end to the resilient portion 43 inside the recess 41. The other end of the rigid portion, in the extended configuration, projects from the recess 41. The rigid portion 42 may be formed of suitable grade of steel. The locking detent 40 is configured to engage a groove in the lock 15.

FIG. 10 shows the locking detent 40 in further detail. The rigid portion 42 is in the form of a circular button with a central, hemispherical projection 44. The hemispherical projection 44 is shaped to be received in the groove of the lock 15. Sides 45 of the rigid portion are raised to define a curved outer facing surface of the rigid portion 42. This curved surface is shaped to conform to the outer surface of the lock 15.

The resilient portion 43 comprises a body that is located in the recess 41 in the ear behind the rigid portion 42 and a casing 46 that extends over the side surfaces of the rigid portion 42. The casing 46 is a thin layer of elastomeric material around the sides of the rigid portion 42 to provide cushioning between the rigid portion and surfaces of the recess 41. This helps to reduce wear on the rigid portion 42 and the recess 41. The body of the resilient portion 43 is provided with an expandable region in the form of a peripheral groove 47. With the resilient portion 43 located in the recess 41 and in its at rest state, the groove 47 defines a cavity. When the locking detent 40 is depressed, the resilient portion 43 is able to be compressed by its expansion into this cavity defined by the groove 47. The resilient portion 43 is configured so that at the point where its expandable region has expanded to contact the wall of the recess 42, the stiffness of the locking detent 40 increases exponentially due to the incompressible nature of the material from which the resilient portion 43 is formed. When this occurs, it becomes difficult to further depress the locking detent 40 (without substantial force). The resilient portion 43 is configured to be at or close to state when the lock 15 is in its operative position so as to ensure that locking detent 40 maintains engagement with the lock 15.

The locking detent 40 also comprises a locating portion 48, in the form of a small protrusion, which keys into a correspondingly shaped part of the recess 41 so as to accurately orient the locking detent 40 in the recess 41.

Figure 21:
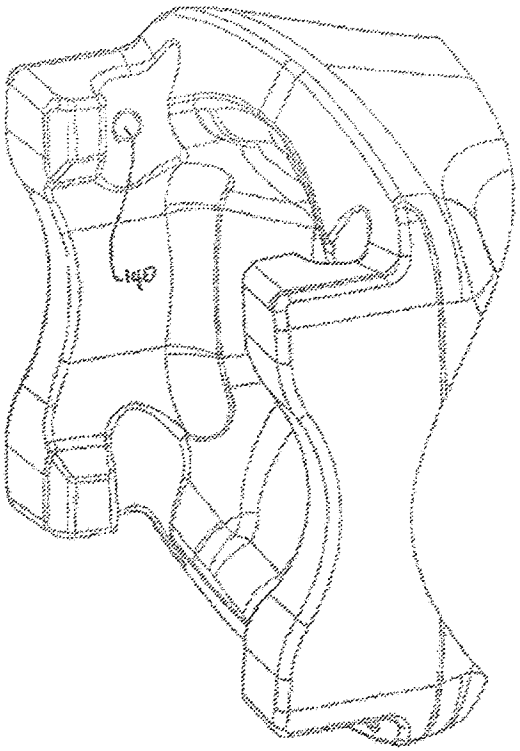
FIG. 21 is partial rear perspective view of a first tooth member of an excavation tooth assembly according to another embodiment of the present disclosure.
Figure 22:
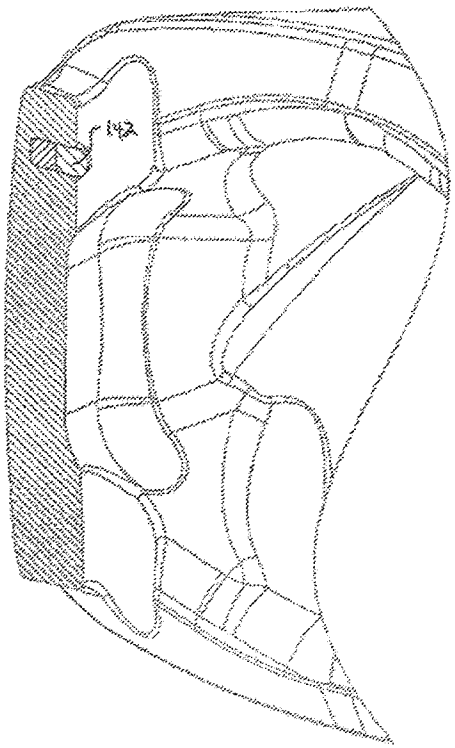
FIG. 22 is a sectional view through an ear of the tooth member of FIG. 21.

In another embodiment shown in FIGS. 21 and 22, the locking detent may be in the form of a depressible boss 140. In this embodiment, the rigid portion 142 has a hemispherical end surface that engages the lock.

Figure 2C:
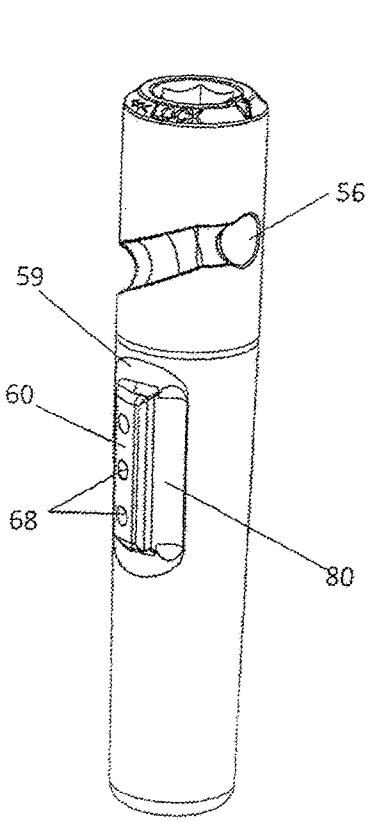
FIGS. 2A-C are a number of elevated side views of a lock of the excavation tooth assembly of FIG. 1.
Figure 2B:
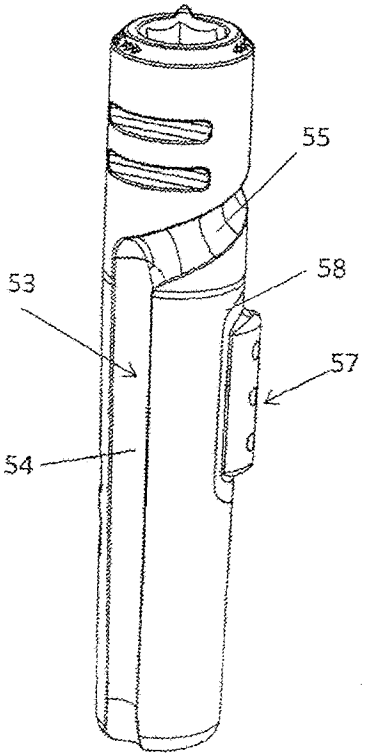
Figure 2A:
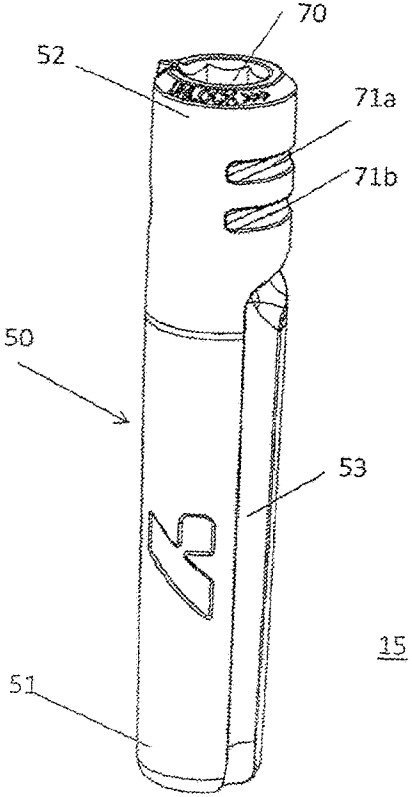

Referring to FIG. 2, the lock 15 comprises a body 50 which is substantially cylindrical in shape and extends along a longitudinal axis between first and second ends 51, 52. The lock body 50 is generally of constant width across its length (other than for a groove and recess in which lateral projection is mounted as will be described below). The lock body may be provided with a slight taper of approximately 1° along at least a portion of its length to its first end 51. The taper eases removal of the lock when the excavation tooth assembly is disassembled, especially if dirt and other material from the digging operation caught in the assembly 10. The locking space 16 in particular the upper and lower curved cavities 26 that are formed in the ear 23 of the first tooth member 11 are shaped to match the outer surface shape of the lock body 50.

Figure 14:
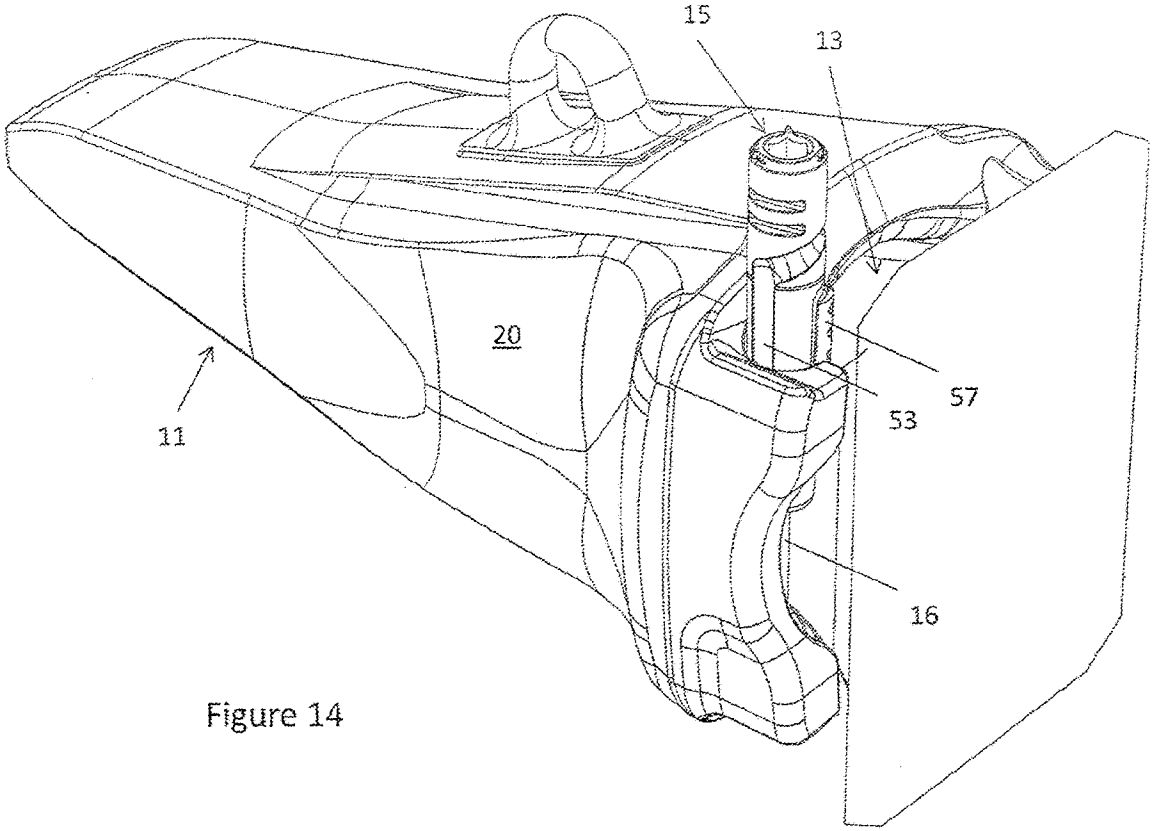
FIGS. 14-19 are show sequentially the lock being inserted into an operative position within a locking space formed between assembled first and second tooth members of the excavation tooth assembly to lock the tooth members in their assembled configuration.
Figure 15:
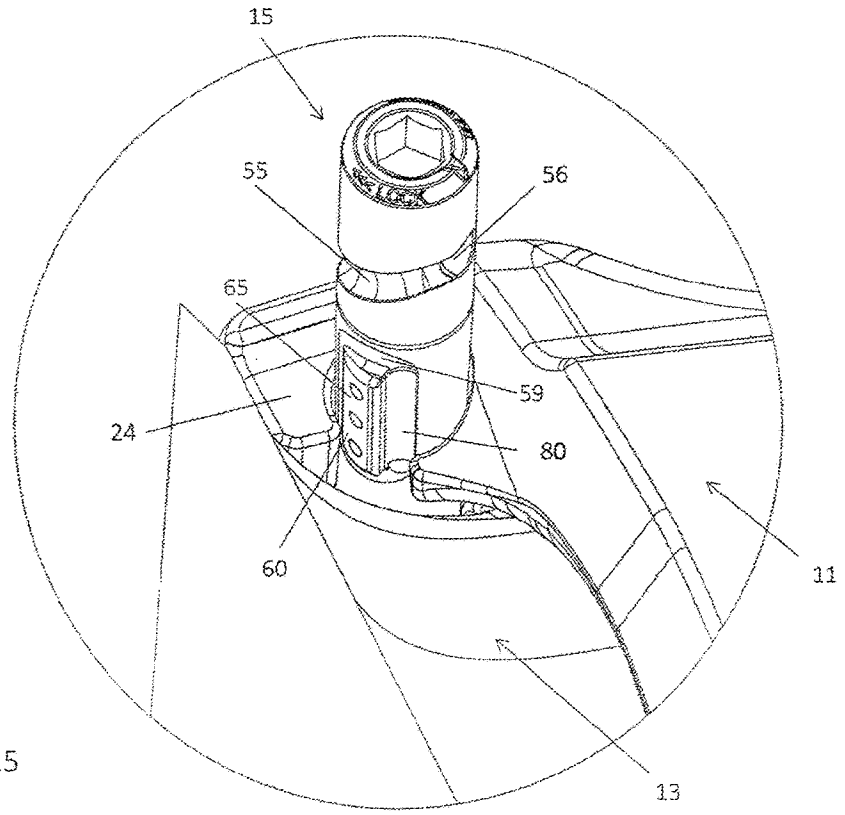
Figure 16:
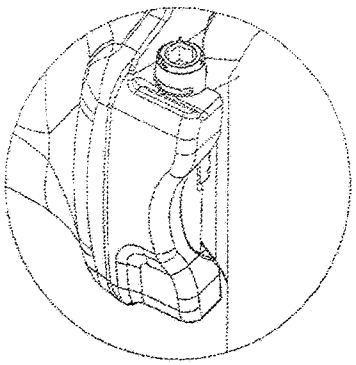
Figure 17:
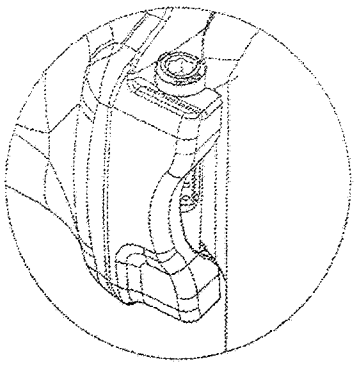
Figure 18:
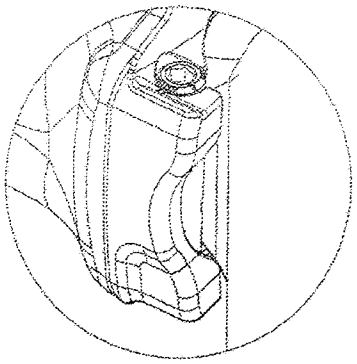
Figure 19:
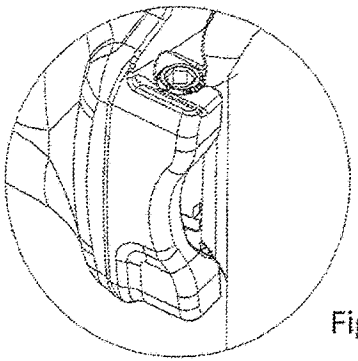

An interengaging element in the form of a groove 53 is formed in the outer surface of the lock body 50, which in use, engages and receives the locking detent 40 when the lock 15 is inserted into the locking space 16. The groove 53 travels over the locking detent 40 as the lock is inserted. This occurs first by partially translating the lock 15 into the locking space as shown in FIGS. 14 and 15 in an axial direction (of the lock), leading with the lock's first end 51, and then by subsequently rotating the lock 15, causing the lock to be drawn further into the locking space 16. Rotation of the lock 15 occurs against a biasing force from the locking detent 40 that is transverse to the longitudinal axis of the lock body. This rotation occurs until the lock 15 is fully received within the locking space and is in an operative position where it is retained in the locking space by the locking detent 40 and as a result is locking the first and second tooth members 11, 13 in their assembled condition (FIG. 19). In this operative position, the lock 15 is retained in a lateral position with respect to the first and second tooth members 11,13 and with the longitudinal axis of the lock body 50 transverse to the longitudinal axes of the tooth members 11, 13.

Figures 8, 9:
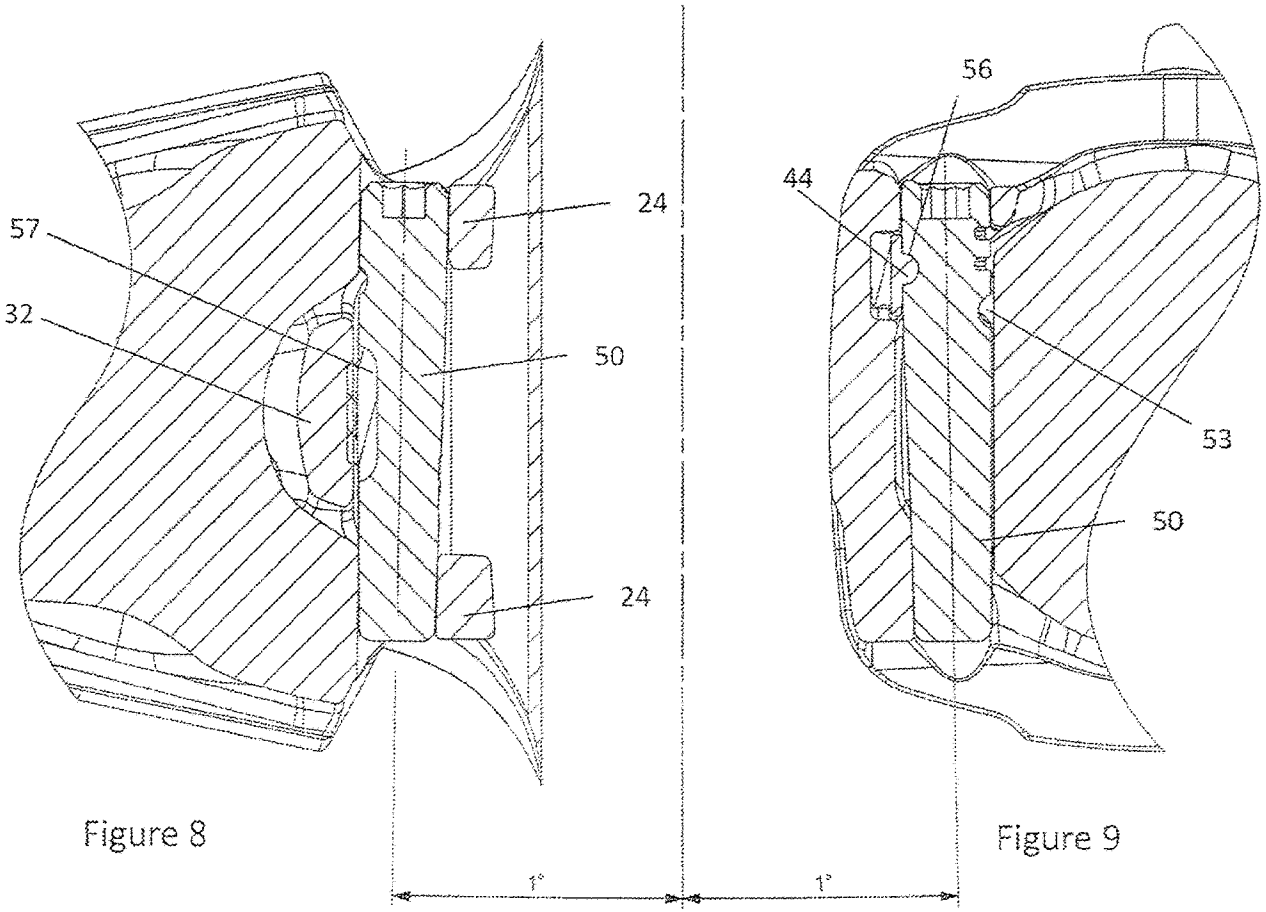
FIGS. 8 and 9 are side and rear sectional views of FIG. 7.
Figure 10B:
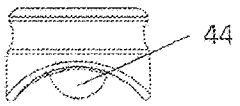
FIGS. 10A-F are perspective, top, side, front and sectional views of a locking detent that is provided in the tooth member of FIG. 3.
Figure 10C:
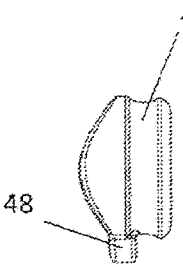
Figure 10D:
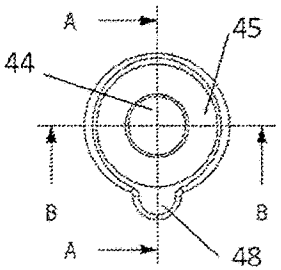
Figure 10E:
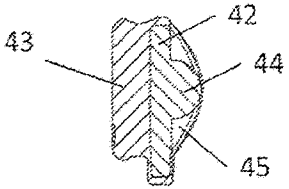
Figure 10F:
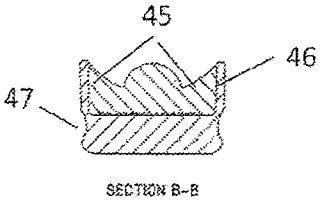
Figure 10A:
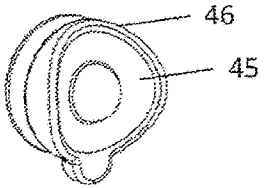
Figure 11:
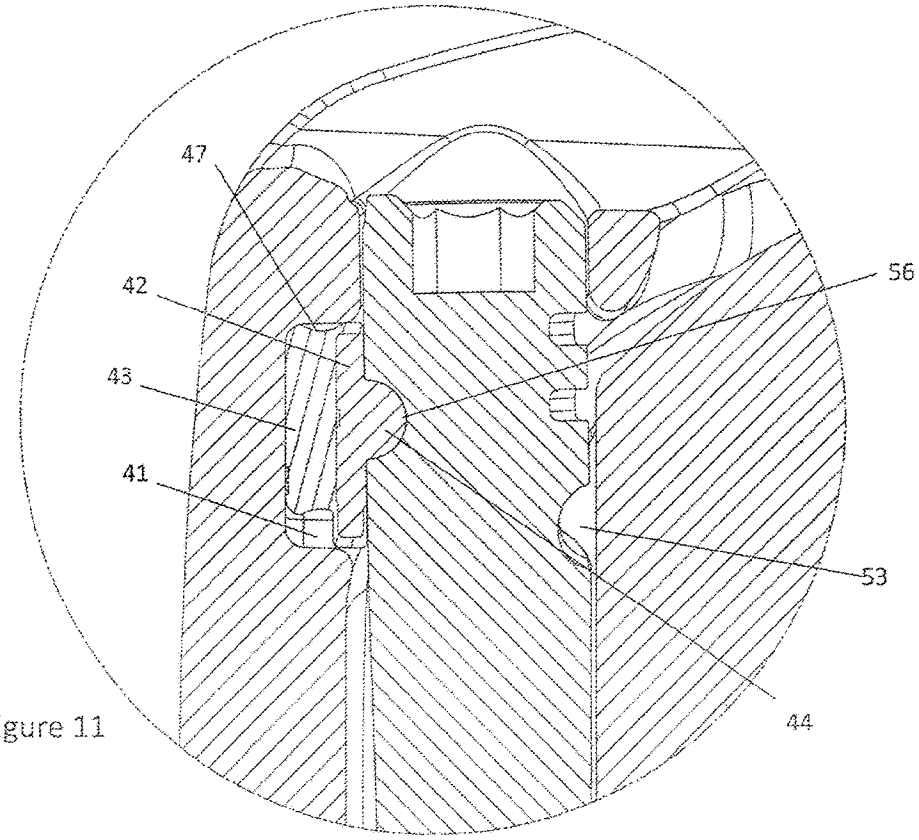
FIGS. 11 and 12 are rear and top sectional views of part of the excavation tooth assembly of FIG. 1 showing the engagement between the locking detent of FIG. 10 and the lock of FIG. 2.
Figure 12:
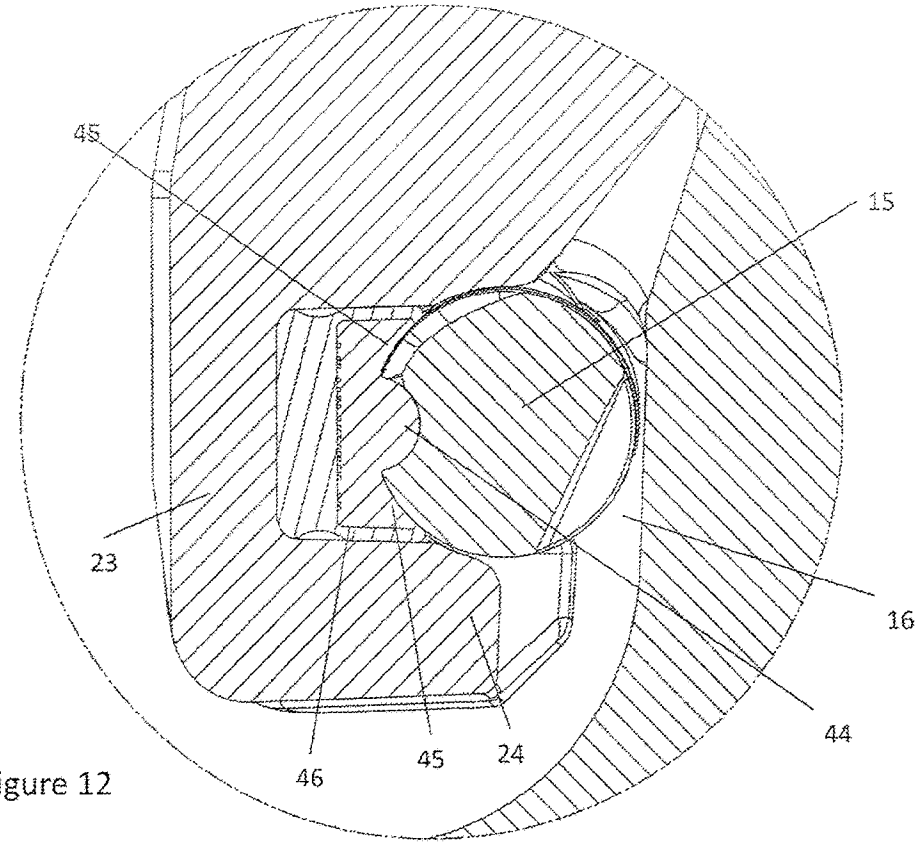
Figure 13A:
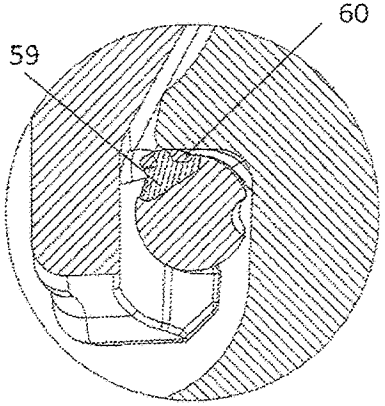
FIGS. 13A-D are a series of views in section transverse to the longitudinal axis of the lock, illustrating, in sequence, the rotation of the lock within the locking space as the lock is inserted therein.
Figure 13B:
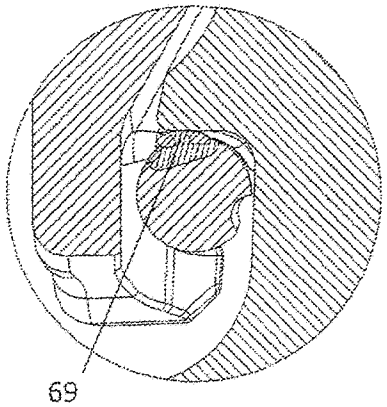
Figure 13C:
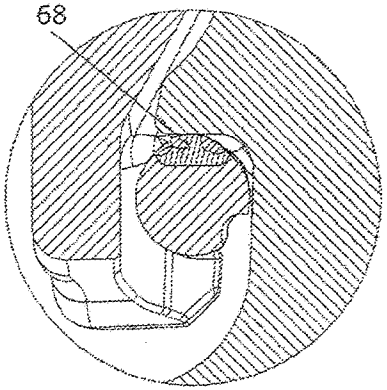
Figure 13D:
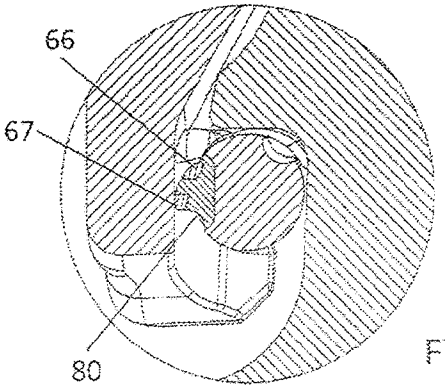
Figure 13E:
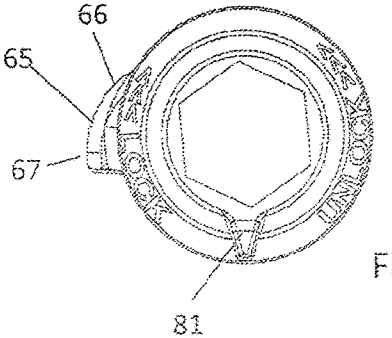
FIG. 13E is a top view of the lock in isolation.

As shown in FIGS. 8 and 9, where the lock body 50 is provided with a taper, the lock 15 is configured so that in its operative position, its tapered surface sits flush against surfaces of the second tooth member 13. This results in the lock being positioned so that its longitudinal axis is at an angle to the perpendicular to the longitudinal axes of the tooth members 11, 13 both longitudinally (FIG. 8) and laterally (FIG. 9). This angle corresponds to the angle of the taper, which is approximately 1°.

An actuator in the form of a hexagonal recess 70 is provided in the second end 52 of the lock body 50 to enable an operator to cause rotation of the lock 15 as required. This is carried out by the operator inserting an appropriately shaped tool into the recess 70. The manner in which the lock 15 is inserted into the locking space 16, means that after it has been inserted, the hexagonal recess 70 remains exposed at the top of the locking space 16. This allows for easy access to the recess 70 for removal of the lock 15 from the locking space 16 when required.

The lock 15 is also provided with a leverage surface in the form of a pair of notches 71*a,b* near the second end 52 of the lock body 50. Each notch 71*a,b* can be engaged by a suitable tool such as a screwdriver or a crowbar to lever the lock 15 out of the locking space 16 and ease disassembly of the excavation tooth assembly 10. Typically, the upper notch 71*a* is first engaged with the tool to make the initial movement of the lock 15 out of the locking space 16 and the lower notch 71*b* is subsequently engaged with the tool to further move the lock out of the locking space. In other embodiments, such as in the embodiment shown in FIG. 23, the lock 215 may be provided with only a single notch 271. However, advantageously, the second notch 71*b* located further away from the second end 52 of the lock body 50 than the first notch 71*a*, further eases removal of the lock 15 from the locking space by providing a greater range of movement of the lock over which it can be levered. This is particularly advantageous where dirt is packed in very tightly around the lock 15 after use such that removal by hand after using only the first upper notch 71*a* is difficult.

To enable the compound movement of the lock 15 in its insertion into the locking space 16, the groove 53 comprises an axial portion 54 that extends over the surface of the lock body substantially parallel to the longitudinal axis of the lock body 50 and a helical portion 55 that extends over the surface of the lock body substantially helically relative to the longitudinal axis of the lock body.

The axial groove portion 54 begins at the first end 51 of the lock body 50 and extends linearly towards the lock body's second end 52 to connect to the helical groove portion 55. The axial groove portion 54 deepens as it extends to the helical groove portion 55. The axial portion 54 thus provides a lead-in for the groove 53 to receive the locking detent 40. The helical groove portion 55 extends from the end of the axial groove portion 54 further towards the second end 52 of the lock body 50, finishing in a hemispherical indentation 56. The indentation 56 is configured to receive and capture the rigid portion 42 of the locking detent 40 when the lock is in its operative position. The helical groove portion 55 extends 180-220° preferably about 215°, around the lock body such that the indentation 56 is displaced 180-220° preferably about 215° from the axial portion 54. Accordingly, the lock is rotated 180-220°, preferably about 215° to complete its insertion into the locking space 16 and bring the lock into its operative position.

The helical groove portion 55 becomes shallower as it extends from the axial groove portion 54 to the indentation 56, with the indentation 56 being deeper than the end of the helical groove portion 55 adjacent to the indentation. As a result, as the lock 15 and the helical groove portion 55 travels over the locking detent 40 on the first tooth member 11, an increasing biasing force from the resilient portion 43 of the locking detent 40 is applied to the lock, transverse to the longitudinal axis of the lock body. This also causes the locking detent 40 to be increasingly depressed towards the ear 23 of the first tooth member. When the lock 15 is sufficiently rotated to bring the indentation 56 into alignment with the locking detent 40, the locking detent is released into the indentation 56 by the bias of the resilient portion 43.

Removal of the lock 15 from the locking space 16 for disassembly of the excavation tooth assembly 10 (for example, when replacing a worn or broken first tooth member) occurs by a reverse of the assembly process. In particular this requires a sufficient rotational force to overcome the bias of the resilient portion 43 of the locking detent and step up in depth from the indentation 56 to the adjacent portion of the helical groove portion 55 to cause the locking detent to pop back out of the indentation. Only a 180-220° preferably about 215° rotation of the lock 15 is required in the removal process before the lock 15 can be simply pulled out or levered out (using the notches 71*a,b*) of the locking space 16, thus enabling a very quick disassembly process.

The lock 15 also has a lateral projection 57 located in and projecting from a recess 58 in the side of the lock body 50. The lateral projection 57 is located in a mid portion of the lock body 50 at approximately 90-110° relative to both the indentation 56 and the axial groove portion 54. The lateral projection has a longitudinal extent that is substantially parallel to the longitudinal axis of the lock body.

The lateral projection 57 comprises a rigid portion 60 and a resilient portion 59. The resilient portion 59 is housed in the lock body recess 58. The rigid portion 60 is attached to the resilient portion 59 and projects beyond the surface of the lock body 50 in an extended configuration. The rigid portion 60 is made for example from a suitable grade of steel. The resilient portion 59, which is formed of an elastomeric material such as rubber, both enables the lateral projection 57 to be depressed towards the lock body 50 and outwardly biases the rigid portion 60 to its extended configuration. The lateral projection 57 acts as a take-up formation to ensure that the tooth members 11, 13 and the lock 15 remain in a tight locking arranged when the parts have worn during use. The lateral projection 57 does this by projecting further out from the lock body under its bias to take up any looseness in the locking arrangement of the lock 15 in the locking space 16.

As shown in FIGS. 13 and 15, as the lock 15 is inserted into the locking space 16, first by translation and then by rotation, the lateral projection 57 is configured to remains clear of contact with the first tooth member 11 and in particular its ear 23. This allows of ease of initial insertion of the lock 15. As the lock 15 is continued to be rotated into the locking space 16, the lateral projection 57, more specifically the rigid portion 60, comes into contact with the wall portion 32 of the second tooth member 13. This engagement with the wall portion 32 causes the lateral projection 57 to be depressed. The rigid portion 60 has a convexly curved outer surface 65 that extends laterally away from the side of the lock body in the direction of rotation of the lock 15 in use from a first side 66 of the rigid portion which is substantially aligned with the side of the lock body 50 to a second side 67 of the rigid portion is disposed laterally away from the lock body. It is thus the first side 66 of the rigid portion that initially comes into contact with the wall portion 32 of the second tooth member 13, in use. This curved configuration of the rigid portion 60 advantageously reduces the shear forces between the rigid portion 60 and the resilient portion 59 during locking and use of the excavation tooth assembly 10. The shear strength of the join between the rigid portion 60 and the resilient portion 59 is further strengthened by the apertures 68 provided through the rigid portion into which projections 69 of the resilient portion 59 extend. The apertures 68 and the projections 69 received in the apertures extend laterally away from the side of the lock body 50. Advantageously, these above mentioned shear strengthening features mitigate the risk of the rigid portion 60 shearing off the resilient portion 59 in use.

A recess 80 is provided in the resilient portion 59 disposed beside the second side 67 of the rigid portion 60. The recess 80 is behind the rigid portion 68 in the direction of rotation of the lock 15 in use. The recess 80 accommodates the deformation of the resilient portion 59 as the rigid portion 60 is brought into engagement with the wall portion 32 of the second tooth member 13.

In the lock 215 shown in FIG. 23, the rigid portion 260 of the lateral projection 257 is provided with a rounded leading edge 261 to ease the initial engagement of the lateral projection 257 with the wall portion 32. The rounded leading edge 261 transitions into a planar surface portion 262. This planar surface portion 262 provides the primary engagement surface of the lateral projection 257 with the wall portion 32 when the lock 215 is completely inserted and in its operative position.

Because the lateral projection 57 engages the wall portion 32 and is outwardly biased, this causes the lock 15 to push on the projections 24 on the first tooth member's ear 23. As a result, the lock 15 acts to continually apply a pulling force on the first tooth member 11 to pull the tooth member onto the second tooth member 13 (and maintain tight engagement).

FIGS. 8, 9, 11 and 12 show the lock 15 in its operative position with the locking detent 40 captured in the indentation of 56 of the lock groove. In this position, the lateral projection 57 engages the wall portion 32 of the second tooth member 13 to keep the lock 15 in tight engagement with the locking space and in particular the indentation 56 of the lock groove 53 in tight engagement with the locking detent 40. When the lateral projection 57 is engaged with the wall portion 32, it is depressed against the bias of its resilient portion 59. However, the bias of the resilient portion provides the lateral projection 57 with take-up should there be any wear on the relevant surfaces of the tooth members 11, 13 or the lock after the parts have been used.

Figure 20:
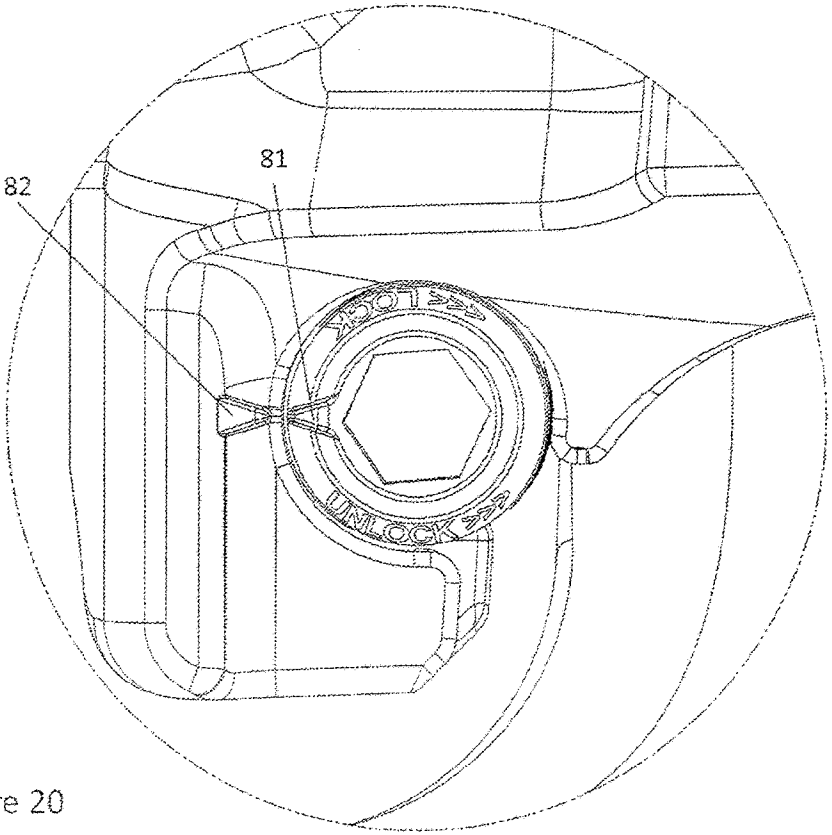
FIG. 20 is a top view of the lock in its operative position within the locking space in which it is locking the tooth members in their assembled condition.

As shown in particular in FIG. 20, the lock 15 and the first tooth member 11 are provided with respective lock indicators 81, 82 in the form of triangular surface projections (although other indicators such as recesses, colour markings and other shaped projections may be used). The lock indicators 81, 82 provide a visual indication of when in the lock 15 is in its operative position in which it is locking the tooth members 11, 12 in their assembled condition. This visual indication is provided when the lock indicators are aligned with each other. The lock indicator 81 of the lock 15 is provided on the end surface of the lock at its second end 52. The lock indicator 82 of the first tooth member 11 is located on the upper (or lower) surface of the ear 23 proximate to the cavity 26 in which locking detent 40 is located.

In the claims which follow and in the preceding disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the present disclosure.

Accordingly, the present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods which can, of course, vary. It is also to be understood that the terminology used herein is for the purpose of describing particular embodiments only, and is not intended to be limiting.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. An excavation tooth lock assembly to lock a first tooth member to a second tooth member, the first tooth member having a body that incorporates a socket which is configured to receive a nose portion of the second tooth member, wherein the lock assembly comprises:

a lock comprising a body having a longitudinal axis, the lock configured to lock the first tooth member to the second tooth member; and an interengaging element disposed on the lock and configured to engage with an interengaging element on at least one of the first and second tooth members, the elements configured to releaseably retain the lock in its operative position, wherein the interengaging element disposed on the lock comprises a groove formed in the lock body, and wherein the groove in the lock body is configured to receive and travel over a locking detent in at least one interengaging element provided on at least one of the first or second tooth members as the lock is inserted into its operative position, and wherein the groove has an axial portion that extends over the surface of the lock body substantially parallel to the longitudinal axis of the lock body and a helical portion that extends from one end of the axial portion over the surface of the lock body, substantially helically relative to the longitudinal axis of the lock body.

2. The excavation tooth lock assembly of claim 1, wherein the lock assembly is configured such that rotation of the lock body about its longitudinal axis brings the lock into an operative position to lock the first tooth member to the second tooth member, and the rotation of the lock body is made against a biasing force which is applied to the lock transverse to the longitudinal axis of the lock body.

3. The excavation tooth lock assembly of claim 2, wherein one of the interengaging elements is depressible and the depressible element provides the transverse bias.

4. The excavation tooth lock assembly of claim 2, wherein the assembly is configured so that the biasing force increases as the lock is rotated to the operative position.

5. The excavation tooth lock assembly of claim 1, wherein the locking detent comprises a rigid portion and a resilient portion and wherein the rigid portion has an extended configuration in which it projects from the recess, the resilient portion biasing the rigid portion towards its extended configuration.

6. The excavation tooth lock assembly of claim 5, wherein the rigid portion comprises a body having outward facing surface shaped to conform to the outer surface of the lock body and a projection from the outward facing surface, configured to be received in the groove of the lock body.

7. The excavation tooth lock assembly of claim 5, wherein the resilient portion comprises an expandable region which is configured to expand when the locking detent is depressed and wherein the expandable region comprises a peripheral groove in the resilient portion.

8. The excavation tooth lock assembly of claim 1, wherein the lock body extends along its longitudinal axis between a first end and a second end, the lock body configured to be rotated about its longitudinal axis when inserted into its operative position and wherein the lock body is substantially cylindrical in shape and the groove extends over the outer surface of the lock body.

9. The excavation tooth lock assembly of claim 8, wherein a portion of the lock body is tapered and wherein the groove extends from the first end towards the second end of the lock body and finishes in a discontinuity for receiving the locking detent when the lock is in its operative position.

10. The excavation tooth lock assembly of claim 9, wherein the groove becomes shallower as it extends towards the discontinuity.

11. The excavation tooth lock assembly of claim 1, wherein the axial portion of the groove deepens as it extends towards the helical portion of the groove.

12. The excavation tooth lock assembly of claim 1, wherein the helical portion of the groove becomes shallower as it extends away from the axial portion.

13. The excavation tooth lock assembly of claim 1, wherein the helical portion extends towards the second end of the lock body as it extends away from the axial portion, whereby, in use, the helical portion causes translation of the lock into or out of the locking space when the lock is rotated.

14. The excavation tooth lock assembly of claim 1, wherein the lock comprises a take-up formation for biasing the first tooth member onto the second tooth member.

15. The excavation tooth lock assembly of claim 14, wherein the take-up formation is configured to expand the lock under its bias.

16. The excavation tooth lock assembly of claim 14, wherein the take-up formation comprises a lateral projection extending from a side of the lock body for engaging one of the surfaces the first tooth member and/or the second tooth member.

17. The excavation tooth lock assembly of claim 16, wherein the lateral portion comprises a rigid portion and a resilient portion.

18. An excavation tooth assembly for attachment to a digging edge, the assembly comprising:

a first tooth member;

a second tooth member, the first tooth member having a body that incorporates a socket which is configured to receive a nose portion of the second tooth member in an assembled condition, the tooth members defining a longitudinal axis when the second tooth member is received in the first tooth member;

a locking space formed between the first and second tooth members and a wall of the nose portion of the second tooth member when the second tooth member is received in the first tooth member in the assembled condition; and a lock comprising a body having a longitudinal axis, the lock is inserted into the locking space by rotating the body about its longitudinal axis to an operative position to lock the tooth members in their assembled condition, wherein in its operative position the lock is arranged with the longitudinal axis of its body transverse to the longitudinal axis of the tooth members; and interengaging elements disposed on the lock and one or both of the first and second tooth members, the elements configured to releaseably retain the lock within the locking space in its operative position wherein the locking space is formed, at least in part, by respective surfaces of the first and second tooth members which are disposed to face laterally relative to the forward and rear ends of the tooth assembly and which are arranged in opposing relation to one another and at least one of the interengaging elements is provided on one of these laterally facing surfaces, wherein the first tooth member comprises an ear that projects away from the socket and which incorporates one of the laterally facing surfaces and wherein another of the laterally facing surfaces comprises a shoulder portion that projects away from the socket of the first tooth member.

19. The excavation tooth assembly of claim 18, wherein at least a portion of the laterally facing surfaces are curved to define a curved cavity in the locking space and wherein the interengaging element disposed on the first and/or second tooth members is located in the curved cavity.

20. An excavation tooth assembly for attachment to a digging edge, the assembly comprising:

a first tooth member;

a second tooth member, the first tooth member having a body that incorporates a socket which is configured to receive a nose portion of the second tooth member in an assembled condition, the tooth members defining a longitudinal axis when the second tooth member is received in the first tooth member, a locking space formed between the first and second tooth members and a wall of the nose portion of the second tooth member when the second tooth member is received in the first tooth member in the assembled condition; and a lock comprising a body having a longitudinal axis, the lock is inserted into the locking space by rotating the body about its longitudinal axis to an operative position to lock the tooth members in their assembled condition, wherein in its operative position the lock is arranged with the longitudinal axis of its body transverse to the longitudinal axis of the tooth members; and interengaging elements disposed on the lock and one or both of the first and second tooth members, the interengaging elements to releasably retain the lock within the locking space in its operative position wherein the locking space is formed, at least in part, by respective surfaces of the first and second tooth members which are disposed to face laterally relative to the forward and rear ends of the tooth assembly and which are arranged in opposing relation to one another and at least one of the interengaging elements is provided on one of these laterally facing surfaces.

21. The excavation tooth assembly of claim 20, wherein the first tooth member is an excavation tooth member and the body of the first tooth member incorporates a first end, an opposite second end that incorporates the socket configured to receive the nose portion of the second tooth member, and the wall extending from the second end of the body and including a depressible locking detent that forms part of a lock assembly to releaseably retain the lock in the locking space.

22. The excavation tooth lock assembly of claim 20, further comprising a take-up formation provided on at least one of the lock, the first tooth member or the second tooth member, the take-up formation biasing the first tooth member onto the second tooth member.

23. The excavation tooth lock assembly of claim 22, wherein the take-up formation is disposed on the lock and is caused to move into engagement with one of the first tooth member or second tooth member on rotation of the body so as to bias the first tooth member onto the second tooth member.

24. The excavation tooth lock member of claim 22, wherein the take-up formation causes tightening of the engagement of the lock with at least one surface of the locking space.

* * * * *